US006234128B1

(12) United States Patent
Reuss

(10) Patent No.: US 6,234,128 B1
(45) Date of Patent: May 22, 2001

(54) FUEL ACCUMULATOR WITH PRESSURE ON DEMAND

(75) Inventor: David L. Reuss, Huntington Woods, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/523,996

(22) Filed: Mar. 13, 2000

(51) Int. Cl.[7] ..... F02M 37/04
(52) U.S. Cl. ..... 123/179.17; 123/447
(58) Field of Search ..... 123/179.17, 447, 123/456, 514, 179.9, 179.12

(56) References Cited

U.S. PATENT DOCUMENTS

| | | | | |
|---|---|---|---|---|
| Re. 33,270 | | 7/1990 | Beck et al. | 123/447 |
| 2,986,881 | * | 6/1961 | Moore | 123/447 |
| 4,627,403 | * | 12/1986 | Matsumura | 123/447 |
| 5,074,263 | * | 12/1991 | Emerson | 123/179.5 |
| 5,121,730 | | 6/1992 | Ausman et al. | 123/467 |
| 5,152,271 | * | 10/1992 | Matsumura | 123/504 |
| 5,176,115 | | 1/1993 | Campion | 123/179.17 |
| 5,199,402 | * | 4/1993 | Melchior | 123/447 |
| 5,213,083 | | 5/1993 | Glassey | 123/447 |
| 5,375,576 | | 12/1994 | Ausman et al. | 123/446 |
| 5,456,233 | * | 10/1995 | Felhofer | 123/447 |
| 5,478,045 | | 12/1995 | Ausman et al. | 251/54 |
| 5,590,631 | * | 1/1997 | Tuckey | 123/447 |
| 5,678,521 | | 10/1997 | Thompson et al. | 123/447 |
| 5,711,263 | * | 1/1998 | Brown | 123/179.9 |
| 5,809,771 | * | 9/1998 | Wernberg | 60/39.094 |
| 6,092,500 | * | 7/2000 | Frank et al. | 123/198 D |

* cited by examiner

*Primary Examiner*—Carl S. Miller
(74) *Attorney, Agent, or Firm*—George A. Grove

(57) ABSTRACT

A fuel system has a pump which supplies fuel under pressure to a fuel rail for distribution by fuel injectors to the cylinders of an engine. A fuel accumulator, having a volume greater than the volume of fuel required to start the engine, is disposed in fluid communication with the fuel rail to supply a charge of fuel thereto during engine start-up at a pressure level sufficient to cause fuel atomization within the cylinder. The fuel in the accumulator is stored at the ambient pressure. A spring force or a solenoid force is applied to the fuel in the accumulator such that the fuel is ejected into the fuel rail at the required pressure level. A check valve is positioned to prevent fuel flow from the fuel rail to the pump during the initial discharge from the accumulator. The accumulator is refilled by fuel from the pump during normal operation and the fuel therein is reduced to ambient pressure when the engine operation is discontinued.

4 Claims, 1 Drawing Sheet

FUEL ACCUMULATOR WITH PRESSURE ON DEMAND

TECHNICAL FIELD

This invention relates to fuel injection systems and more particularly to a system for providing a volume of fuel to the fuel injectors at engine start-up.

BACKGROUND OF THE INVENTION

Internal combustion engines utilize many types of fuel injection such as manifold injection, port injection and direct injection. Direct injection engines have a fuel feed system that injects fuel directly into the combustion chamber of the engine. Direct injection engines employ high pressure fuel systems in order to more fully atomize the fuel in the combustion chamber. At start-up of the engine, it is desirable to have the operating pressure of the fuel system be at a sufficient level to achieve proper atomization to sustain low emission levels. It generally requires a number of engine revolutions before the fuel system attains the desired pressure level. This delays the engine start-up.

To alleviate this condition, it has been proposed to install a passive high pressure accumulator to the fuel system such that fuel is stored at the desired pressure between engine shut-off and the next engine start-up. These systems have two drawbacks. The storage of high pressure fuel is undesirable and the accumulators often "leak down" between shut-down and start-up, if the period is long, thereby defeating the purpose of the accumulator.

SUMMARY OF THE INVENTION

It is an object of the present invention to provide an improved direct injection fuel system having an accumulator.

In one aspect of the present invention, an accumulator stores fuel at a low pressure between engine shut-down and engine start-up. In another aspect of the present invention, the fuel stored in the accumulator is delivered to the fuel injectors at a high pressure at engine start-up. In yet another aspect of the present invention, a stored force is applied to the fuel in the accumulator to eject the fuel therefrom and rapidly pressurize the fuel system at the injectors. In still another aspect of the present invention, a spring-loaded piston is employed to force the fuel from the accumulator during engine start-up.

In yet still another aspect of the present invention, the accumulator is filled and the spring-loaded piston is reset by the pressurized fuel supplied from a fuel pump during engine operation. In a further aspect of the present invention, a solenoid-actuated piston is employed to provide the force used to expel the fuel from the accumulator. In a yet further aspect of the present invention, a pressure-on-demand system is provided to assist rapid engine starting by producing a high pressure fuel charge, from low pressure accumulator stored fuel, to the fuel injectors of the engine only at the beginning of the engine-starting operation but prior to pressurized fuel from the normal fuel injection pump becoming available.

DESCRIPTION OF EXEMPLARY EMBODIMENTS

Figure 1:
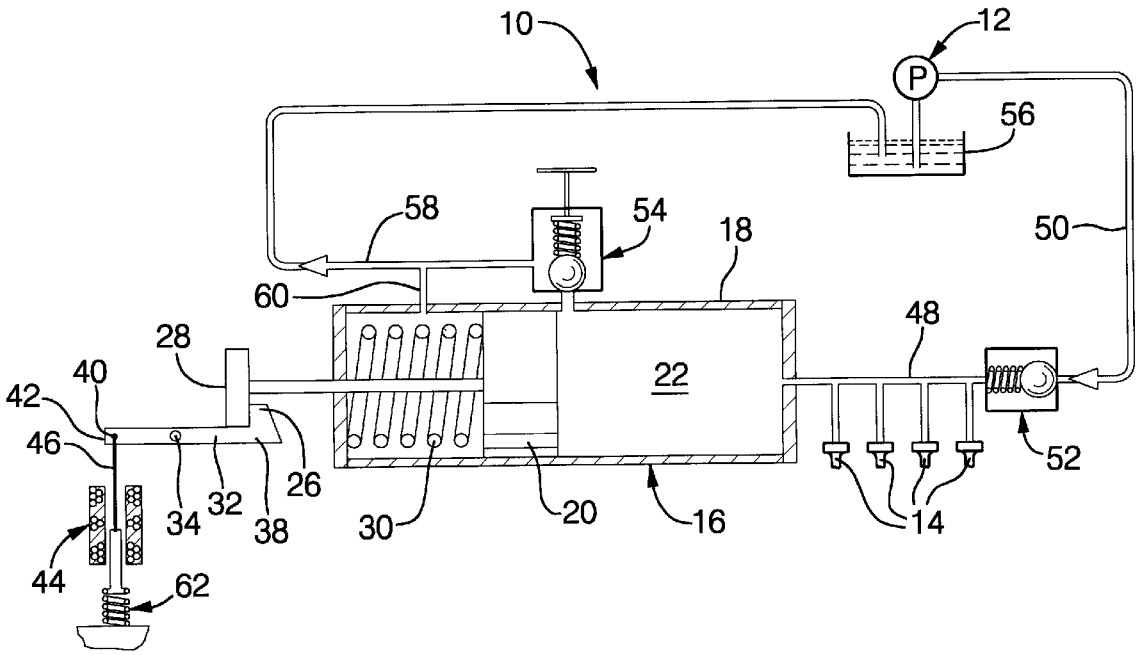
FIG. 1 is a schematic representation of a portion of a fuel injection system incorporating one embodiment of the invention.

A portion of a fuel system 10 is shown in FIG. 1. The fuel system includes a high pressure fuel pump 12, a plurality of fuel injectors 14 and an accumulator 16. The pump 12 and fuel injectors 14 are conventional fuel system components. The pump 12, when operating, will deliver pressurized fuel in the range of 1 to 150 megapascals (Mpa). The injectors 14 are operated by the vehicle electrical system as controlled by the engine electronic control mechanism, not shown, in a well-known manner.

The accumulator 16 has a housing 18 in which is slidably disposed a piston 20. The housing 18 and piston 20 cooperate to form an expansible fuel accumulator chamber 22 and an expansible spring chamber 24. A piston rod 26 extends from the piston 20 to a catch member 28 which is outboard of the housing 18. A spring 30, trapped between the housing 18 and the piston 20 in the spring chamber 24, surrounds the piston rod 26. The piston 20 and the spring 30 are shown in a latched condition in which a force is stored in the spring 30.

The catch member 28 is held in the latched condition by a latch member 32. The latch member 32 is pivotally mounted on a pin 34. The latch 32 has a latch finger 36 at one end 38 and a control point 40 at the other end 42. The latch finger 36 engages the catch member 28 to hold the piston 20 in the latched condition. The control point 40 is operatively connected with a solenoid assembly 44 through a rod 46. The operation of the solenoid assembly 44 is controlled in a conventional manner by the vehicle electrical system such that the solenoid assembly is energized at engine start-up and de-energized after engine state-up.

The pump 12 is in fluid communication with a fuel rail 48 through a passage 50 and a conventional check valve 52. The fuel rail 48 supplies pressurized fuel to the injectors 14. The fuel rail 48 is also in fluid communication with the fuel accumulator chamber 22. The volume of the chamber 22 is greater than the volume of fuel required to start the engine. The housing 18 is in fluid communication through a fuel pressure regulator valve 54 which is in fluid communication with a fuel tank or reservoir 56 through a fuel return passage 58. The spring chamber 24 is also in fluid communication with the fuel return passage 58 through an exhaust or vent port 60.

Assuming that the engine has been started previously, the chamber 22 will be full of fuel and the latch 32 will hold the piston 20 in the position shown. When the operator engages the start circuit, the solenoid 44 will actuate the latch member 32 to release the piston 20 and the spring 30 will urge the piston 20 rightward, as viewed in FIG. 1. The piston 20, under the influence of the spring 30, will force the fuel from chamber 22 into the fuel rail 48 at a rate required to feed the engine during start-up. Since the volume of the chamber 22 is greater than the volume of fuel required to state the engine, the accumulator will continue to supply fuel to the fuel rail 48 until the pump 12 is operable. The force stored in the spring 30 will determine the pressure of the fuel delivered to the fuel rail 48 during start-up. The amount of fuel ejected from the fuel accumulator will depend on the number of rotational cycles the engine undergoes prior to the pressure output of the pump 12 reaching the normal operating range. The spring 30 is designed to produce a pressure level in the fuel that is equal to or greater than the minimum pressure required to atomize the fuel as it is injected into the engine cylinders. The minimum pressure requirement will depend on the engine; for example, a diesel engine may have a higher requirement than a spark ignition engine.

The pump 12 is started simultaneously with the release of the piston 20; however, a brief period of time is required for the pump 12 to raise the pressure level of the fuel system into the operating range. This time period can be sufficient to permit several revolutions of the engine prior to ignition. With the present invention, the fuel rail 48 is fully charged and the engine cylinders receive the proper fuel/air mixture to support combustion. The check valve 52 prevents the fuel in the fuel rail 48 from flowing toward the pump 12 and simultaneously insures that the pump pressure is sufficient to overcome the pressure of the fuel in the fuel rail 48.

When the pump 12 generates the required pressure level, the check valve 52 will admit fuel from the pump 12 into the fuel rail 48. Since the normal operating pressure of the pump 12 is greater than the load supportable by the spring, the piston will be urged leftward in the chamber 22 against the spring 30. When the catch member 28 abuts the latch finger 36, the latch member 32 will pivot clockwise about the pin 34. When the catch member 28 has moved leftward sufficiently to clear the end 38, a low force tension spring 62 will pivot the latch member 32 counterclockwise, thereby holding the piston 20 in the spring-loaded position shown.

The regulator valve 54 will be placed in fluid communication with the chamber 22 and the fuel rail 48 to control the output pressure of the pump 12 when the piston has moved to the spring-loaded position shown. When the engine is shut down, the regulator valve is operated to reduce the pressure in the fuel rail 48 and chamber 22 to ambient pressure by returning any excess fuel to the tank 56. The fuel system is then prepared for the next engine start-up. The fuel stored in the chamber 22 is at a pressure level substantially equal to the pressure level in the fuel tank 56.

Figure 2:
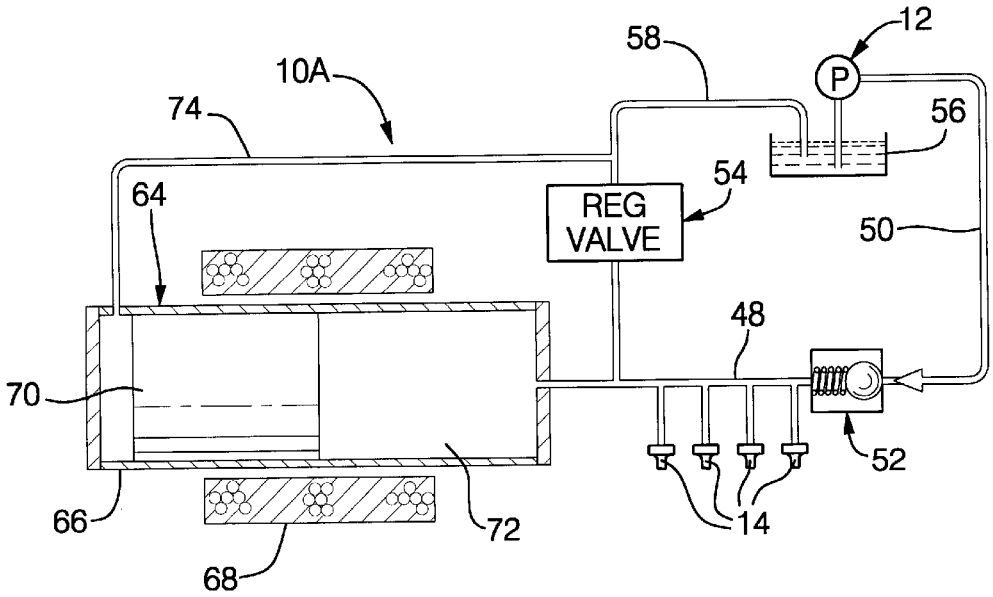
FIG. 2 is a schematic representation of a portion of a fuel injection system incorporating another embodiment of the invention.

A fuel system 10A, shown in FIG. 2, includes the fuel pump 12, check valve 52, fuel rail 48, regulator valve 54 and a fuel accumulator 64. The fuel rail 48 distributes fuel to the injectors 14 in a well-known manner. The accumulator 64 includes a housing 66, a solenoid 68 and a piston 70. A return passage 74 connects the area between the left end of the piston 70 and the housing 66 with the fuel tank 56 to ensure that any fuel leaking past the piston 70 does not interfere with the leftward movement of the piston 70. The piston 70 is slidably disposed in the housing 66 and cooperates therewith to form a fuel accumulator chamber 72 that is in fluid communication with the fuel rail 48. The solenoid 68 is disposed circumjacent a portion of the housing 66 such that, when energized, the solenoid 68 will urge the piston 70 rightward in the housing 66, thereby reducing the volume of the chamber 72. As described above for the fuel system 10A, the volume of the chamber 72 is greater than the volume of fuel required to start the engine.

When the operator places the ignition circuit in the start mode, the regulator valve 54 is conditioned to control the fuel pressure in the fuel rail 48 within the desired operating range and the solenoid 68 is energized. The solenoid will force the piston rightward, thereby ejecting the fuel in the chamber 72 into the fuel rail 48 to raise the pressure level therein to at least the minimum required for atomization of the fuel as it is injected into the engine cylinders through the injectors 14. The pump 12 is also operated at this time, but, as described above, the output pressure thereof will take a small amount of time to develop to the required level. However, the fuel expelled from the chamber 72 will permit the injectors to supply fuel at the proper pressure level to the cylinders of the engine. The check valve 52 prevents back flow of fuel from the fuel rail 48 to the pump 12 prior to the pump output pressure reaching the required level. At engine start or when the pump output pressure level is within the required range, the solenoid is de-energized and the excess fuel from the pump 12 will force the piston to the position shown and the chamber 72 will be filled with fuel. The regulator valve 54 will control the pressure in the fuel rail 48 during engine operation and will permit the pressure level in both the fuel rail 48 and the chamber 72 to be reduced to the ambient pressure of the fuel tank 56.

What is claimed is:

1. A fuel system for a direct injection engine comprising:

a fuel pump;

a fuel rail disposed in fluid communication with said pump;

a fuel accumulator disposed in fluid communication with said fuel rail including means for forcing fuel from said accumulator into said fuel rail during engine start-up, said accumulator storing fuel at an ambient pressure level between engine shut down and engine restart;

said means for forcing fuel from said accumulator comprising a spring positioned between an accumulator housing and a piston;

latching means for holding said piston in a spring loaded position during normal engine operation and;

means for releasing said latching means during engine start-up and said spring urging said piston to force fuel from said accumulator into said fuel rail during engine start-up.

2. A fuel system for a direct injection engine comprising:

a fuel pump;

a fuel rail disposed in fluid communication with said pump;

a fuel accumulator disposed in fluid communication with said fuel rail including means for forcing fuel from said accumulator into said fuel rail during engine start-up, said accumulator storing fuel at an ambient pressure level between engine shut down and engine restart;

said means for forcing fuel from said accumulator comprising a solenoid disposed circumjacent said housing and being selectively energizable to urge said piston to expel fuel from said accumulator chamber.

3. A fuel system for a direct injection engine comprising:

a fuel pump;

a fuel rail disposed in fluid communication with said pump;

a fuel accumulator disposed in fluid communication with said fuel rail including means for forcing fuel from said accumulator into said fuel rail during engine start-up, said accumulator storing fuel at an ambient pressure level between engine shut down and engine restart;

said means for forcing fuel from said accumulator comprising a spring positioned between an accumulator housing and a piston, and latching means for holding said piston in a spring loaded position during normal engine operation.

4. The fuel system for a direct injection engine defined in claim 1 further comprising:

a fuel pressure in said fuel rail resetting said piston to said spring-loaded position during normal engine operation when fuel is being supplied by said pump.

* * * * *